US007602294B2

(12) United States Patent
Forrest et al.

(10) Patent No.: US 7,602,294 B2
(45) Date of Patent: Oct. 13, 2009

(54) ACROSS THE PAVEMENT WIRELESS SECURITY SYSTEM

(75) Inventors: Simon J. Forrest, Dundee (GB); Karl Roberts, Cheshire (GB)

(73) Assignee: NCR Corporation, Dayton, OH (US)

( * ) Notice: Subject to any disclaimer, the term of this patent is extended or adjusted under 35 U.S.C. 154(b) by 520 days.

(21) Appl. No.: 11/634,700

(22) Filed: Dec. 6, 2006

(65) Prior Publication Data

US 2008/0136636 A1 Jun. 12, 2008

(51) Int. Cl.
*G08B 13/14* (2006.01)

(52) U.S. Cl. ..... 340/572.1; 340/686.1; 340/539.1

(58) Field of Classification Search ..... 340/686.1, 340/686.6, 539.1, 539.18, 539.21, 539.23, 340/572.1–572.9
See application file for complete search history.

(56) References Cited

U.S. PATENT DOCUMENTS 4,975,680 A * 12/1990 Fogle, Jr. ..... 340/571
6,065,408 A * 5/2000 Tillim et al. ..... 109/25
6,191,690 B1 * 2/2001 Mukogawa ..... 340/568.7
6,761,308 B1 * 7/2004 Hanna et al. ..... 235/379
6,845,905 B2 * 1/2005 Blad et al. ..... 235/375
2006/0163797 A1 * 7/2006 Schmidt et al. ..... 271/145
2007/0187485 A1 * 8/2007 Aas et al. ..... 235/379
2008/0111679 A1 * 5/2008 Ogg et al. ..... 340/539.13
2008/0223930 A1 * 9/2008 Rolland et al. ..... 235/385

* cited by examiner

*Primary Examiner*—Davetta W Goins
*Assistant Examiner*—Edny Labbees
(74) *Attorney, Agent, or Firm*—Michael Chan

(57) ABSTRACT

A system and method for establishing and maintaining wireless communications links between a secure vehicle, a self-service terminal, and an item being transferred therebetween. The item to be transferred, the secure vehicle and the self-service terminal are equipped with short-range communications devices to enable the detection of proximity there between. The security personnel are also equipped with a short-range wireless communications device to enable the detection of proximity between the security personnel and the item. A security system of the item to be transferred is activated dependent upon the proximity between the security personnel and the item. The security system may be primed and turned off by detection of proximity between the short-range wireless communications devices of the item to be transferred and the secure vehicle or self-service terminal respectively.

14 Claims, 2 Drawing Sheets

ACROSS THE PAVEMENT WIRELESS SECURITY SYSTEM

TECHNICAL FIELD

The present invention relates to a wireless security system for the transfer of valuable goods between secure locations. It is particularly related to, but in no way limited to, the transfer of cash cassettes between a secure vehicle and an automated transaction machine (ATM).

BACKGROUND

Various organizations have a need to transport valuable items of one kind or another between physically separated locations in a secure manner. Possibly the most common example of this requirement is the transfer of banknotes from a central or local storage point to one or more Automated Teller Machines (ATMs). Due to the popularity of ATMs they require frequent replenishing with banknotes and therefore a relatively large amount of money is generally in transit between one or more financial institutions and ATMs. The secure transport of this money and the security of personnel employed in this task is naturally of great concern to financial institutions who run ATM networks.

The banknotes dispensed by an ATM are held in individual cassettes, sometimes known as cash cassettes, each cassette containing banknotes of one particular denomination. Cassettes are loaded with the banknotes at a central location and transported to the vicinity of an ATM by a secure vehicle. Upon arrival nearby to the ATM the cassettes of banknotes are carried by security personnel from the secure vehicle to the ATM where they are loaded into the ATM. During the transport from the secure vehicle to the ATM the cassettes are at their most exposed to theft and the security personnel are exposed to the risk of attack by persons wishing to steal the cassettes.

When cash cassettes are transferred between secure vehicles and ATMs they are typically housed within a container to provide additional security. Cash cassettes are placed into the container prior to be being transferred from the secure vehicle, and removed from the container as they are loaded into an ATM. The transfer of cassettes from a secure vehicle to an ATM typically occurs between a vehicle at the road-side and a building. Accordingly, the transfer is commonly known as an "across the pavement" transfer and the containers used to house the cassettes during the transfer are known as Across The Pavement (ATP) devices.

ATP devices and/or cash cassettes typically include spoiling systems or other security devices which are activated upon theft of the device and/or cassette. Such systems are disclosed in European patent EP1196897 and European patent application 04256771.9. The security systems may be activated by a timer which is set to monitor the time of transit of the ATP device between the secure vehicle and the ATM, commonly known as the walk time. Should the security personnel become delayed between the security vehicle and the ATM there may be insufficient time on the timer to reach the ATM and there is therefore the possibility of an incorrect activation of the security system. The security system may also be activated in other manners, for example by the ATP device being opened incorrectly. However, that may not be a deterrent as thieves may believe they can overcome the security system and therefore successfully access the cash within the cash cassette.

The successful transfer of ATP devices from secure vehicles to ATMs and the loading of the cash cassettes from ATP devices into the correct pick unit of an ATM is reliant on a number of actions being executed correctly by the security personnel. In order to open an ATP device, and to open the ATM itself, the security personnel must carry identifiers to access the ATP device and the ATM. Upon arrival at the ATM the security personnel must unlock the ATP device and the ATM and then correctly insert the cash cassettes into the correct pick unit of the ATM prior to relocking the ATM. The security personnel must therefore carry the code or keys to access the ATM and ATP device. This is both inconvenient and allows the possibility of a thief obtaining the code/keys and accessing the ATP device or ATM.

There is therefore a requirement for a security system which overcomes the problems of a time-activated security system and that also addresses the problems associated with access to the ATP device and/or ATM.

SUMMARY

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

According to a first aspect of the present invention, there is provided a system for use during the transport of an item from a vehicle to a self-service terminal, the system comprising: a first short-range wireless communications device for association with the item to be transported, and a second short-range wireless communications device for association with personnel transporting the item, the first and second short-range wireless communications devices being configured to detect proximity there between, a first long-range wireless communications device located in the vehicle and a second long-range wireless communications device associated with the personnel, the first and second long-range wireless communications devices being configured to establish a wireless link there between, and a wireless detector located in the vehicle and configured to wirelessly detect the movement of the item out of that vehicle, a security system of the item being primed upon such detection, wherein the security system is arranged to activate dependent upon the proximity of the first and second short-range wireless communications devices during transport of the item.

The security system may be reset via the wireless communications links.

The security system may comprise a timer to activate the security system, the timer being started on wireless detection of the transfer of the item out of the vehicle.

The timer may be reset via the wireless communications links.

The system may further comprise a third short-range wireless communications device located in the self-service terminal.

The security device may be configured to be turned off upon detection of proximity between the first and third short-range wireless communication devices.

The system may further comprise a third long-range wireless communications device located in the self-service terminal and configured to establish a wireless communications link with the first long-range wireless communications device.

The short-range wireless communication devices may be RFID devices.

According to a second aspect of the present invention there is provided a method of transferring an item from a vehicle to a self-service terminal, comprising the steps of transferring the item out of the vehicle to personnel and priming a security system of the item upon wireless detection of that transfer, establishing a wireless communications link between the item and the vehicle, wirelessly monitoring the proximity of the item and the personnel transporting the item, and transporting the item to the self-service terminal, wherein during transport of the item, the security system is activated dependent upon the proximity between the item and the personnel.

The method may further comprise the step of resetting the alarm system dependent upon a signal received by the item via the wireless communications link.

The step of priming a security system may comprise starting a timer of that security system, wherein the timer is configured to activate the security system.

The method may further comprise the step of re-setting the timer dependent upon a signal received by the item via the wireless communications link.

The method may further comprise the step of turning off the security system upon wireless detection of proximity between the item and the self-service terminal.

The wireless communications link may be established via a wireless communications device of the personnel transferring the item from the vehicle to the self-service terminal.

The method may be performed by firmware or software in machine readable form on a storage medium.

This acknowledges that firmware and software can be valuable, separately tradable commodities. It is intended to encompass software, which runs on or controls "dumb" or standard hardware, to carry out the desired functions. For similar reasons, it is also intended to encompass software which "describes" or defines the configuration of hardware, such as HDL (hardware description language) software, as is used for designing silicon chips, or for configuring universal programmable chips, to carry out desired functions.

The preferred features may be combined as appropriate, as would be apparent to a skilled person, and may be combined with any of the aspects of the invention.

BRIEF DESCRIPTION OF THE DRAWINGS

Embodiments of the invention will be described, by way of example, with reference to the following drawings, in which.

Figure 1:
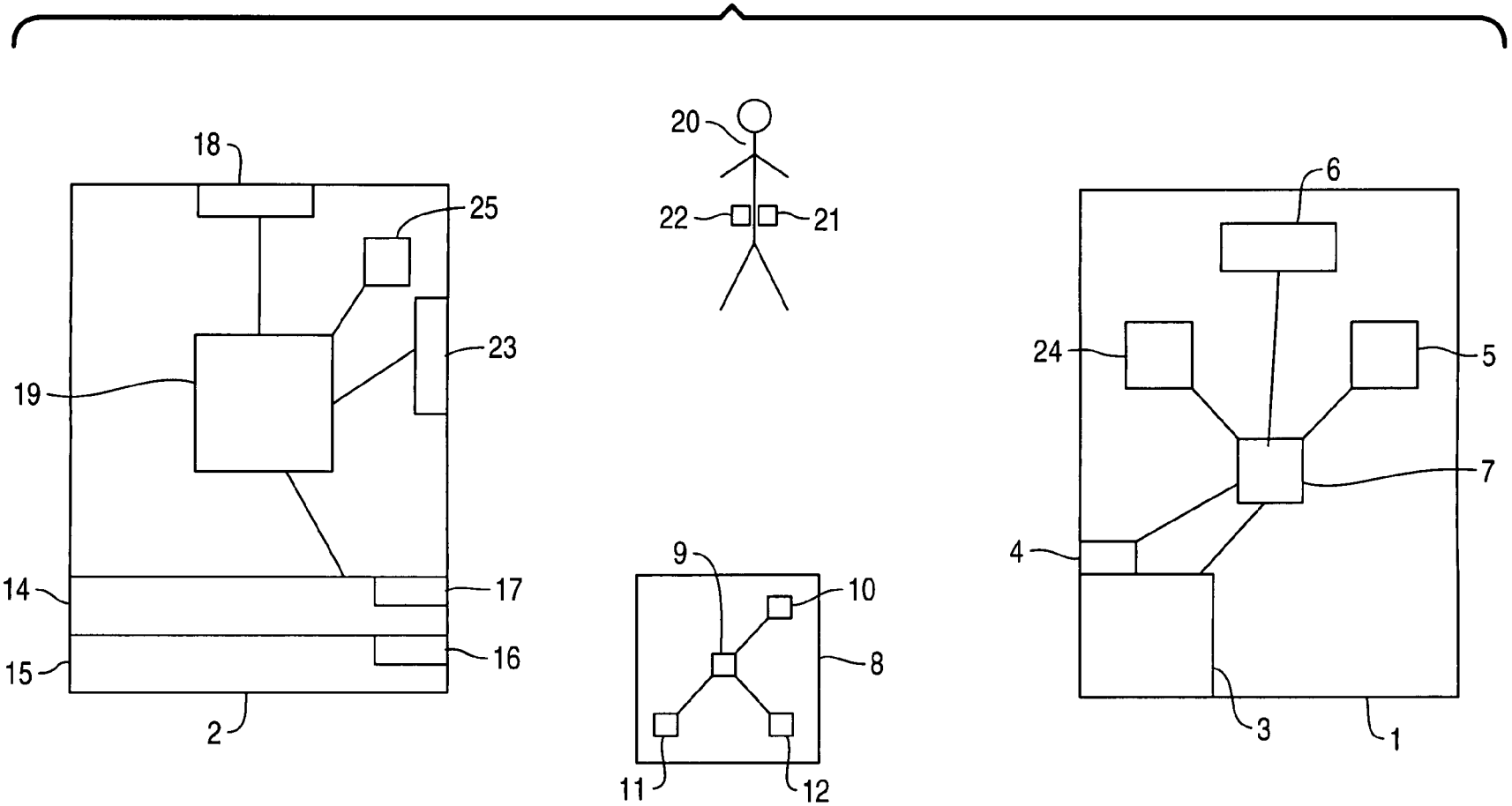
FIG. 1 is a schematic diagram of an security system for use during the delivery of cash cassettes to an ATM.

Common reference numerals are used throughout the figures to indicate similar features.

DETAILED DESCRIPTION

Embodiments of the present invention are described below by way of example only. These examples represent the best ways of putting the invention into practice that are currently known to the Applicant although they are not the only ways in which this could be achieved.

FIG. 1 shows a security system for use during the delivery of currency from a secure vehicle 1 to an ATM 2. The secure vehicle 1 is equipped with a transfer device 3 to enable Across The Pavement (ATP) devices to be transferred into and out of the secure interior of the secure vehicle 1. A short-range wireless communications device 4 is provided to communicate with short-range wireless communications devices mounted on ATP devices being passed through the transfer device 3. The secure vehicle 1 is also equipped with a GPS tracking system 5 and a long-range wireless communication system 6. An external wireless communication system 24 for communication with a remote location, for example a central control centre, is also provided. A processing system 7 is connected to each of the devices to exchange information between the devices and to control them.

An ATP device 8 is equipped with a processor 9 which is connected to a short-range wireless communications device 10, long-range wireless communications device 11 and also a security system 12. The security system 12 may be, for example, a media spoiling system.

The terms "short-range" and "long-range" are used throughout to indicate the typical relative operational distances of those devices in the context of the current system. Short-range devices may have an operational range of the order of centimeters to tens of centimeters, whereas long-range devices may have an operational range of the order of meters to tens of meters. RFID devices are an example of a short-range wireless communications device. RFID tags can communicate wirelessly with an RFID reader located nearby. RFID systems may be utilized in the current system and may be beneficial as the tags may be unpowered, thereby removing the need for a power supply to certain devices. The long-range devices may be provided, for example, according to the Zigbee™ protocol. As will be understood by the person skilled in the art other technologies are also suitable to provide the functionality of the long- and short-range devices described herein.

ATM 2 has a plurality of pick units 14, 15, each of which is equipped with a short-range wireless communications device 16, 17. The ATM 2 is also equipped with a long-range wireless communications device 18 and a processing system 19, connected to the various parts of the ATM 2 for control thereof and/or exchange of information therewith. The pick units 14, 15 of the ATM are contained within a safe, the lock 23 of which may be operated by a short-range wireless communications device 25.

ATP device 8 is carried between the secure vehicle 1 and the ATM 2 by security personnel 20. The security personnel may be equipped with a long-range wireless communications device 21 and a short-range wireless communications device 22.

Long-range wireless communications devices 6, 11, 18 and 21 are configured to establish communications there between and are configured to exchange information between some or all of the secure vehicle 1, ATM 2, ATP device 8 and security personnel 20. That information may be the status of any of those devices and the equipment in which they are located, a request for information relating to any of those devices or other information entered or requested by an operator or system. Furthermore, wireless links between the devices may be utilized for personnel at each of the locations to communicate between themselves, for example for the security personnel 20 to communicate with personnel located in the secure vehicle 1.

Short-range wireless communications device 4 is mounted in, or in close relation to, the transfer device utilized for transferring items into and out of the secure vehicle 1. As an ATP device 8 is transferred through the transfer device, the short-range wireless communications devices 4, 10 of the transfer device 3 and ATP device 8 are brought within communications range and can exchange information. Information relating to the details of the particular ATP device 8 may be transferred to the processor 7, or instructions may be sent from the processor 7 to the ATP device 8 to activate its security system 12 because it is being transferred out of the secure vehicle 1. As will be apparent to the person skilled in the art, many different pieces of information, or different instructions, may be transferred between the ATP device 8 and the secure vehicle's processing system 7, the above only being given as examples.

Cash cassettes transported within the ATP device 8 may also be equipped with short-range wireless communications devices which may also communicate with the short-range wireless communications device 4. Such communications allow the identification of details of the cash cassettes, for example their content, being transferred out of the secure vehicle 1. Alternatively or additionally, short-range wireless communications devices of the cash cassettes may communicate via the short-range wireless communications devices of the ATP device.

Figure 2:
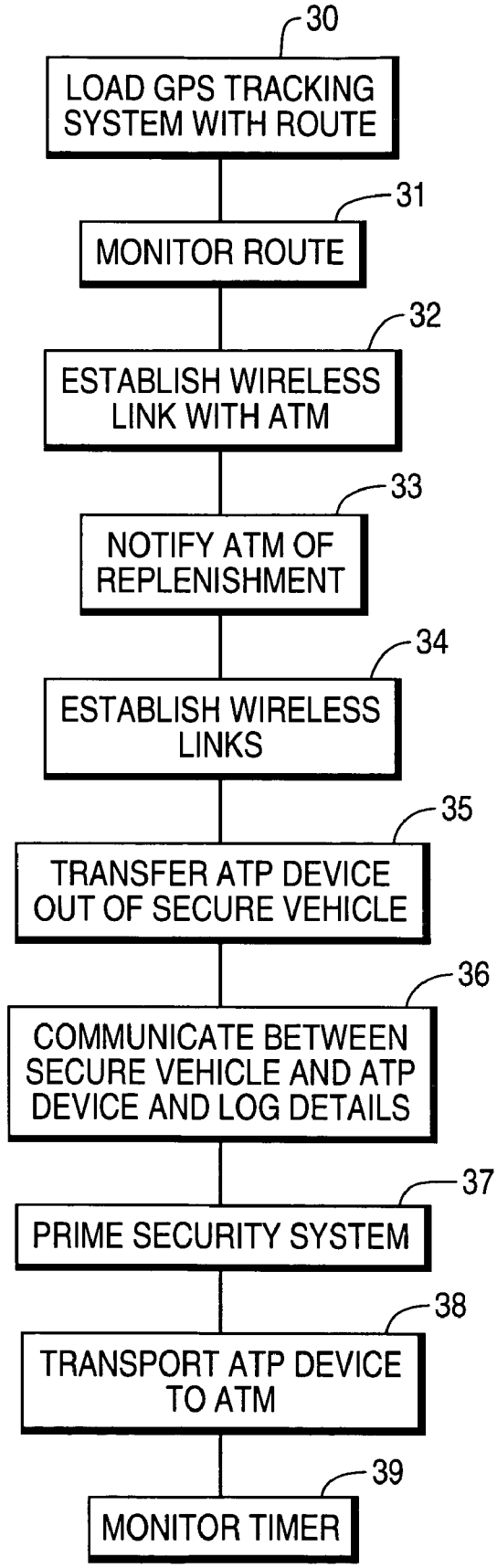
FIG. 2 is a flow diagram of a method for the replenishment of ATMs.

FIG. 2 shows a flow diagram of a method of replenishing an ATM 2 from a secure vehicle 1. Prior to departure of the secure vehicle 1 from a central depot, the route information and delivery schedule are loaded (step 30) into the GPS tracking system 5 of the secure vehicle 1. The actual route followed by the secure vehicle 1, as monitored (step 31) by the GPS tracking system 5, is compared to the expected route and alarms may be generated if the secure vehicle 1 deviates from the scheduled route.

Upon arrival of the secure vehicle 1 at an ATM 2 to be replenished, a wireless communications link is established (step 32) between the long-range wireless communications devices 6, 18 of the secure vehicle 1 and the ATM 2. The secure vehicle 1 announces its presence via that wireless communications link to the ATM 2 and notifies (step 33) the ATM 2 that a replenishment is about to be commenced. Prior to indicating that replenishment is to be commenced, the secure vehicle 1 may interrogate the ATM 2 to determine whether the ATM 2 can accept replenishment. For example, the ATM 2 may have a malfunction that will prevent replenishment. In that case the replenishment may be terminated before the ATP device 8 is transferred out of the secure vehicle to avoid exposing the ATP device 8 to any unnecessary risk. The processing systems 7, 19 of the secure vehicle 1 and the ATM 2 are therefore able to monitor the progress of the replenishment. The secure vehicle 1 and ATM 2 may communicate to confirm that replenishment is required and may take place.

Cash cassettes are released from the internal security systems of the secure vehicle 1 and loaded into an ATP device 8 for transfer to the ATM 1. That commencement of the transfer of the cash out of the secure vehicle may be logged by the processing system 7 of the secure vehicle 1, or notified to an external system via an external wireless communications system 24. Furthermore, the ATM 2 may be notified of the commencement of the transfer via the wireless communications link.

A wireless communications link is established (step 34) between the security personnel 20 and the secure vehicle 1 using long-range wireless communications devices 6, 21. Further wireless communications links may also be established between the ATP device 8 and the ATM 2 and/or secure vehicle 1.

The ATP device 8 is then passed (step 35) through the transfer device 3 of the secure vehicle 1 to security personnel 20 outside of the secure vehicle 1 for transport to ATM 2. As the ATP device 8 is passed through the transfer device 3, the short-range wireless communications devices 4, 10 of the ATP device 8 and secure vehicle 1 communicate (step 36). Those communications may be utilized to determine characteristics of the ATP device 8, for example, its serial number, or details of its contents. Furthermore, short-range wireless communications devices of cash cassettes within the ATP device 8 may be communicated with to determine more details of the contents. The information may be logged by the processing system 7, or communicated to the ATM 2, or to other external locations via external wireless communications device 24.

Upon detection of transfer out of the secure vehicle 1, by the communications between the short-range wireless communications devices 4, 10 the security system 12 of the ATP device 8 is primed (step 37).

Short-range wireless communications device 22 carried by the security personnel establishes communications to the short-range wireless communications device 10 of the ATP device, in order to determine proximity between the security personnel 20 and the ATP device 8.

The actions performed to prime the security system 12 will depend upon the type of security system 12. For example, an alarm system may be turned on such that it is activated by movement of the ATP device 8 away from the security personnel 20 carrying the ATP device 8. Alternatively, or additionally, the security system 12 may include a timer based system. Priming the security system 12 in that case would comprise setting and starting the timer. In addition to, or in place of, the timer, the security system may include sensors to detect attack and to trigger the alarm.

Throughout the transfer (step 38) to the ATM 2, the secure vehicle 1 security personnel 20 remain in contact via the wireless communications links and can exchange information with regard to the progress of the transfer. That communication may be in the form of data sent between the systems, or may be a voice communication between the security personnel 20 and personnel in the secure vehicle 1.

During transport the timer is monitored (step 39), and should the timer run down before delivery of the ATP device 8 to the ATM 2, an alarm may be activated. The security personnel 20 may use the wireless links to the secure vehicle 1 to indicate that the security personnel 20 have become delayed on the journey from the secure vehicle 1 to the ATM 2 and that there is no cause for concern. An alarm will not therefore be raised. The timer may then reset by communications between the security personnel 20 and the ATP device 8, or on instructions transmitted from the secure vehicle 1 to the security personnel 20 or ATP device 8 via the long-range wireless communication devices 6, 11, 18, 21. Since the timer can be reset and controlled remotely, there is no risk of the security system 12 being activated in the event of a delay that is not due to a threat to security. However, should the timer run down due to a theft of the ATP device 8, the security system 12 will be activated since no signal will be sent by the security personnel 20 or secure vehicle to prevent that activation. As explained above, other systems may be provided to trigger the alarm. Those systems may also be triggered accidentally and the wireless communications links may be utilized to reset the system in that event.

Upon arrival of the security personnel 20 at the ATM 2 with the ATP device 8, communications are established between the short-range wireless communication devices 10, 18, 25 of the ATM 2, security personnel 20 and ATP device 8 respectively. Those communications enable the ATM 2 to determine that the expected delivery has arrived, and that the safe should be unlocked. The short-range wireless communications device 25 may be a separate system within the ATM, or may be integrated into the lock 23.

Lock 23 under control of the short-range wireless communications device 25 may be in place of, or in addition to, conventional manual locks. Confirmation of safe arrival of the ATP device 8 at the ATM 2 may be provided by the security personnel 20 via the wireless communications links or by the ATM 2 detecting the proximity of the ATP device 8 and transmitting that information via the wireless communications links. A combination of detection of proximity of the security personnel 20 and ATM 2 and manual communication from the security personnel 20 is therefore utilized to ensure correct opening of the ATM 2 and/or ATP device 8. The arrival may also be logged in the processing systems 7, 19, transmitted to the secure vehicle 1 via the wireless communications links and/or transmitted to external locations.

Following confirmation of arrival of the ATP device 8 at the ATM 2 and opening of the ATP device 8 and ATM 2 the security personnel 20 proceeds to replenish the ATM 2 in the conventional manner by transferring cash cassettes from the ATP device 8 to the pick units 14, 15 of the ATM 2. The pick units are equipped with short-range wireless communications devices 16, 17 which may be utilized to communicate with short-range wireless communications devices of the cash cassettes being placed into the pick units. Those communications may be used to record the cassettes loaded, and may also be used to indicate to the security personnel 20 into which pick unit a given cash cassette should be loaded. The ATM processing system 19 is therefore aware of the cassettes loaded, and also those removed, and can therefore track its contents. The information relating to the cassettes loaded may be transmitted to the secure vehicle 1 such that the replenishment can be recorded, and also so that a further verification can take place that the correct cash cassettes have been loaded. The ATM may also include security systems to detect unauthorized removal of cash cassettes, or attacks made against the cash cassettes. Furthermore, those security systems may be operative in conjunction with alarm and spoiling systems built in to the cash cassettes. Those security systems may be configured to communicate via the wireless communications links to notify the secure vehicle, security personnel or other locations of an unauthorized removal of, or attack against, the cash cassettes.

Once the replenishment is complete the ATM safe may be locked by the security personnel 20, or by detection of the ATP device 8 and/or security personnel 20 moving out of proximity to the ATM 2.

The long-range wireless communications device 21 and/or short-range wireless communications device 22 of the security personnel 20 may either be carried by the security personnel 20, or may be built-in to equipment carried or worn by the security personnel 20, for example, a belt.

The long-range wireless communications devices may also be utilized to calculate the approximate location of the ATP device during transport between the secure vehicle 1 and the ATM 2. For example, signal strength measurements may provide an indication of the progress of the security personnel 20 between the secure vehicle 1 and ATM 2. That information may be utilized in conjunction with timer information to determine whether a delivery is proceeding normally.

The long-range wireless communications device 11 may be omitted in preference to that of the security personnel 20. Long-range wireless communications device 21, in conjunction with the communications link between the short-range wireless communications devices of the security personnel 20 and ATP device 8 may then be utilized to communicate and monitor information regarding the ATP device 8. Such a system may be beneficial as it allows the methods and systems described herein to be utilized with pre-existing ATP devices to which wireless communications devices may not be fittable.

The long-range wireless communications devices of the ATM 2, ATP device 8, secure vehicle 1 and the security personnel 20 enable voice and/or data communications between those devices. It is therefore possible for those devices to exchange information about the progress of replenishment of an ATM 2 during that process.

The GPS tracking system enables the location of the secure vehicle to be monitored at all times and particularly during the replenishment of an ATM 2. Should the location of the secure vehicle 1 not match that expected, an alarm may be raised, for example by wireless communication with a central control centre using radio system 24.

Any range or device value given herein may be extended or altered without losing the effect sought, as will be apparent to the skilled person.

The steps of the methods described herein may be carried out in any suitable order, or simultaneously where appropriate.

It will be understood that the above description of a preferred embodiment is given by way of example only and that various modifications may be made by those skilled in the art.

As will be apparent to the person skilled in the art, features of the apparatus and methods described herein are interchangeable. Accordingly features of the apparatus and system described previously may be utilized in the method, and features of the method may be incorporated into the features provided by the system and apparatus.

In foregoing description and figures the wireless communications device and processing system have been described as separate units. As will be understood by the person skilled in the art, a single device may provide the functionality of both the wireless communications device and the processing system.

The above description has referred to the delivery of bank notes to ATMs, but as will be apparent to the person skilled in the art, the description is also relevant to the delivery of any valuable items to a particular location, including, but not limited to, other types of self-service terminals dispensing valuable items to customers.

What is claimed is:

1. A system for use during the transport of an item from a vehicle to a self-service terminal, the system comprising:

a first short-range wireless communications device for association with the item to be transported, and a second short-range wireless communications device for association with personnel transporting the item, the first and second short-range wireless communications devices being configured to establish a wireless communications link there between and to detect proximity there between, a first long-range wireless communications device located in the vehicle and a second long-range wireless communications device associated with the personnel, the first and second long-range wireless communications devices being configured to establish a wireless communications link there between, and a wireless detector located in the vehicle and configured to wirelessly detect the movement of the item out of that vehicle, a security system of the item being primed upon such detection, wherein the security system is arranged to activate dependent upon the proximity of the first and second short-range wireless communications devices during transport of the item.

2. A system for use during the transport of an item as claimed in claim 1, wherein the security system can be reset via the wireless communications links.

3. A system for use during the transport of an item as claimed in claim 1, wherein the security system comprises a timer to activate the security system, the timer being started on wireless detection of the transfer of the item out of the vehicle.

4. A system for use during the transport of an item as claimed in claim 3 wherein the timer can be reset via the wireless communications links.

5. A system for use during the transport of an item as claimed in claim 1, further comprising a third short-range wireless communications device located in the self-service terminal, the first and third short-range wireless communications devices being configured to establish a wireless communications link there between and to detect proximity there between.

6. A system for use during the transport of an item as claimed in claim 5, wherein the security device is configured to be turned off upon detection of proximity between the first and third short-range wireless communication devices.

7. A system for use during transport of an item as claimed in claim 1, further comprising a third long-range wireless communications device located in the self-service terminal and configured to establish a wireless communications link with the first long-range wireless communications device.

8. A system for use during the transport of an item as claimed in claim 1, wherein the short-range wireless communication devices are RFID devices.

9. A method of transferring an item from a vehicle to a self-service terminal, comprising the steps of:

transferring the item out of the vehicle to personnel and priming a security system of the item upon wireless detection of that transfer, establishing a wireless communications link between the item and the vehicle, wirelessly monitoring the proximity of the item and the personnel transporting the item using a first wireless communications device associated with the item and a second wireless communications device associated with the personnel, and transporting the item to the self-service terminal, wherein during transport of the item, the security system is activated dependent upon the proximity between the item and the personnel.

10. A method of transferring an item from a vehicle to a self-service terminal as claimed in claim 9, further comprising the step of resetting an alarm system dependent upon a signal received by the item via the wireless communication link.

11. A method of transferring an item from a vehicle to a self-service terminal as claimed in claim 9, wherein the step of priming a security system comprises starting a timer of that security system, wherein the timer is configured to activate the security system.

12. A method of transferring an item from a vehicle to a self-service terminal as claimed in claim 11, further comprising the step of re-setting the timer dependent upon a signal received by the item via the wireless communications link.

13. A method of transferring an item from a vehicle to a self-service terminal as claimed in claim 9, further comprising the step of turning off the security system upon wireless detection of proximity between the item and the self-service terminal.

14. A method of transferring an item from a vehicle to a self-service terminal as claimed in claim 9, wherein the wireless communications link is established via the second wireless communications device of the personnel transferring the item from the vehicle to the self-service terminal.

* * * * *